US010443887B2

(12) United States Patent
Salomonsson et al.

(10) Patent No.: US 10,443,887 B2
(45) Date of Patent: Oct. 15, 2019

(54) VENTILATION DEVICE WITH VARYING AIR VELOCITY

(71) Applicant: LINDAB AB, Båstad (SE)

(72) Inventors: Robert Salomonsson, Ronneby (SE); Göran Hultmark, Göteborg (SE); Anders Vorre, Lynge (DK)

(73) Assignee: LINDAB AB, Båstad (SE)

( * ) Notice: Subject to any disclaimer, the term of this patent is extended or adjusted under 35 U.S.C. 154(b) by 22 days.

(21) Appl. No.: 15/114,215

(22) PCT Filed: Feb. 10, 2015

(86) PCT No.: PCT/SE2015/050158

§ 371 (c)(1),
(2) Date: Jul. 26, 2016

(87) PCT Pub. No.: WO2015/122832

PCT Pub. Date: Aug. 20, 2015

(65) Prior Publication Data

US 2017/0227251 A1 Aug. 10, 2017

(30) Foreign Application Priority Data

Feb. 11, 2014 (SE) ..... 1450147

(51) Int. Cl.
*F24F 13/24* (2006.01)
*F24F 13/12* (2006.01)
(Continued)

(52) U.S. Cl.
CPC ..... *F24F 13/24* (2013.01); *F24F 7/00* (2013.01); *F24F 13/06* (2013.01); *F24F 13/085* (2013.01);
(Continued)

(58) Field of Classification Search
CPC .. F24F 13/24; F24F 13/06; F24F 13/12; F24F 2013/242
(Continued)

(56) References Cited

U.S. PATENT DOCUMENTS 2,837,990 A * 6/1958 Tutt ..... F24F 13/062 3/62
3,010,692 A 11/1961 Jemtoft
(Continued)

FOREIGN PATENT DOCUMENTS

EP 1063479 A2 12/2000
EP 1628084 A1 2/2006
(Continued)

OTHER PUBLICATIONS

International-Type Search Report from corresponding Swedish Patent Application No. 1450147-2, dated Aug. 27, 2014.
(Continued)

*Primary Examiner* — Steven B McAllister
*Assistant Examiner* — Ko-Wei Lin
(74) *Attorney, Agent, or Firm* — Tucker Ellis LLP

(57) ABSTRACT

A ventilation device 21 configured to be connected to a mouth of a ventilation duct 9 between the ventilation duct and an outside space. The ventilation device comprises an airflow opening 27 for passage of an airflow 30 between the ventilation device and the outside space. An air-permeable material 29 is arranged in the airflow opening 27.

32 Claims, 12 Drawing Sheets

(51) Int. Cl.

| | |
|---|---|
| ***F24F 13/16*** | (2006.01) |
| ***F24F 7/00*** | (2006.01) |
| ***F24F 13/06*** | (2006.01) |
| ***F24F 13/08*** | (2006.01) |
| ***F24F 13/10*** | (2006.01) |

(52) U.S. Cl.
CPC ..... *F24F 13/10* (2013.01); *F24F 13/12* (2013.01); *F24F 13/16* (2013.01); *F24F 2013/242* (2013.01)

(58) Field of Classification Search
USPC ..... 454/270–274, 292, 248, 298, 300, 323, 454/334, 303, 354
See application file for complete search history.

(56) References Cited

U.S. PATENT DOCUMENTS

2004/0061087 A1* 4/2004 Lindborg ..... F16K 1/123 251/121
2005/0064779 A1* 3/2005 Allison ..... B32B 3/16 442/181
2007/0054612 A1* 3/2007 Ehrman ..... E04D 13/174 454/365
2007/0178826 A1* 8/2007 Takeshita ..... F24F 12/006 454/292
2010/0192689 A1* 8/2010 Ulm ..... B81B 7/0012 73/430
2013/0056564 A1 3/2013 Borut

FOREIGN PATENT DOCUMENTS

| | | | |
|---|---|---|---|
| EP | 2177842 | A1 | 4/2010 |
| EP | 2325571 | A2 | 5/2011 |
| EP | 2503255 | A2 | 9/2012 |
| GB | 726882 | A | 3/1955 |
| GB | 2464746 | A | 4/2010 |
| JP | 2010249368 | A | 11/2010 |
| KR | 200448247 | Y1 | 3/2010 |
| SE | 442669 | B | 3/1983 |
| SE | 0600141 | L | 7/2007 |
| WO | 0235157 | A1 | 5/2002 |

OTHER PUBLICATIONS

International Search Report from corresponding International Patent Application No. PCT/SE2015/050158, dated May 21, 2015.

* cited by examiner

VENTILATION DEVICE WITH VARYING AIR VELOCITY

TECHNICAL FIELD

Ventilation of dwellings, properties, and other buildings, including both feed air ventilation and exhaust air ventilation.

BACKGROUND OF THE INVENTION

Ventilation systems commonly used in buildings, especially in spaces such as bedrooms and bathrooms, often include a ventilation duct to one end of which a fan is coupled. A ventilation device is arranged at the other end. Often, also one or more additional ventilation devices is/are connected to mouths of the ventilation ducts at different positions along the ventilation ducts. Said ventilation duct often extends over several different spaces in the property, for ventilation of those spaces. The ventilation device has an adjustable opening, here referred to as airflow opening, with which the airflow through the ventilation device between the ventilation duct and outside space can be adjusted. When the ventilation device is connected to a mouth of the ventilation duct, the airflow into or out of the ventilation duct can be adjusted by adjusting the size of the airflow opening.

The airflow through a ventilation device depends on factors such as the fan's effect, the dimensions of the ventilation duct, and the size of the airflow opening of the ventilation device. Here, the dimension of the ventilation duct refers to its diameter. When the ventilation system comprises a plurality of ventilation devices, such devices are generally set such that the various ventilation devices have different sizes of the airflow opening in order to thereby adjust the pressure distribution in the ventilation system. By adjusting the airflow opening of the various ventilation devices, unnecessarily high pressures can be throttled down. In this way, a predetermined airflow is obtainable through the respective ventilation devices, i.e. a desired degree of ventilation is obtainable in all spaces in which one or more ventilation devices is/are arranged. Too low airflow causes inadequate ventilation, while too high airflow causes increased energy costs.

The airflow, i.e. amount of feed air or exhaust air, is generally set according to current practice, in accordance with the dimensions of the ventilation duct.

To achieve that airflow calls for a certain pressure distribution in the ventilation system.

It is a problem with these systems that they generate sound which may be perceived as disturbing. For these ventilation systems there are therefore threshold values for maximum recommended sound effect level. Especially, sound is generated in the ventilation device at airflow through its opening towards the surroundings, i.e. the airflow opening. The threshold values for permissible sound effect level generated by the respective ventilation devices set limits to how large a pressure drop can be accomplished over the ventilation device, i.e. which opening degree the respective ventilation devices can have. This also sets limits to which airflow can be obtained through the ventilation device.

As mentioned above, a ventilation system usually comprises a plurality of ventilation devices at different distances from the fan. As the pressure generated by the fan is lowest at the ventilation device located furthest from the fan, said ventilation device is set with maximal opening, i.e. said ventilation device has maximal airflow opening size. The pressure required over said ventilation device to achieve a specified airflow determines the fan's operating conditions. To minimize energy consumption, a pressure drop should be as low as possible.

At the same time, a specified airflow must be obtained also through other ventilation devices being positioned closer to the fan and thus experiencing a higher pressure from the fan. Therefore, a certain degree of throttling of the pressure over the respective ventilation devices, a certain degree of pressure drop, is called for so that the specified airflow is neither exceeded nor underpassed. However, the recommended maximum sound effect level sets limits as to how much the pressure over a ventilation device can be throttled, because of the sounds occurring at airflow through the ventilation device. As will be described in more detail below, factors, such as the size of the airflow opening of the ventilation device, the dimensions of the ventilation device, and the size of an airflow there through, affect the sound effect level generated in the ventilation device at airflow there through. Therefore, the maximal degree of throttling of the pressure in a ventilation device obtainable over a ventilation device, without the recommended maximum sound effect level being exceeded, should be as high as possible to obtain effective ventilation throughout the entire ventilation system. Overall, these factors thus set limits as to the ventilation system.

A ventilation system for feed air ventilation has been described above. The same applies also to exhaust air ventilation.

SUMMARY

It is an object of the invention to provide a ventilation device with substantially retained good ventilation properties with improved acoustic properties in that it generates less sound. Thus, it is an object to provide a ventilation device wherein a high degree of pressure throttling can be accomplished without the recommended threshold values for sound effect levels being exceeded. Pressure throttling refers to restriction of the airflow caused by applied pressure, which occurs as a result of a size of the ventilation device's opening. To limit the airflow to a certain value thus requires a higher degree of throttling when there is a high pressure over the ventilation device.

The pressure distribution in a ventilation system as described above should also be optimized so that the pressure drop over the ventilation device, which determines the operating conditions of the ventilation fan, is as low as possible, to minimize the fan's energy consumption. This means that the pressure drop which must be overcome to obtain the specified airflow through the ventilation device positioned at the greatest distance from the fan should be as low as possible. In order to be able to obtain effective ventilation with the desired flow also in ventilation systems with long ventilation ducts it should be possible to sufficiently throttle the pressure over the ventilation devices located closer to the fan without exceeding the threshold value for accepted sound effect level, while at the same time the specified airflow is maintained.

Recommended threshold value for sound effect level generated by the ventilation device is often set at 30 dB (A), measured by standardized measurements at a certain distance from the ventilation device. For ventilation ducts with a diameter of 125 mm, an airflow of 20 l/s is often strived at. These values are given here as examples. For ventilation ducts with other dimensions there are other standards or other practice for airflow.

A ventilation device is presented which is configured to be connected to a ventilation duct. The ventilation device comprises an airflow opening for passage of an airflow. An air-permeable material is disposed in the airflow opening. The ventilation device is configured to be connected to a mouth of the ventilation duct so that the airflow opening of the ventilation device constitutes the opening of the ventilation duct to the space to be ventilated. The airflow opening faces the space in which the ventilation device is arranged, and is the portion of the ventilation device which is, flowwise, furthest from the ventilation duct. The ventilation device can be used in various types of ventilation devices. It is specifically designed for use in ventilation systems for properties such as dwellings, offices, etc. The ventilation device may be designed as a feed air device or an exhaust air device. If the ventilation device is a feed air device, the airflow opening represents the last passage of the airflow out of the ventilation device, i.e. the airflow opening corresponds to the last throttling in the ventilation system. If the ventilation device is an exhaust air device, the airflow opening represents the first passage of the air into the ventilation device, i.e. the airflow opening corresponds to the first throttling in the ventilation system. Generally, the airflow opening has the shape of a peripheral gap between two portions of the ventilation device. To arrange an air-permeable material in the airflow opening has been found to give surprisingly good sound properties while maintaining the desirable ventilation properties. Currently, it is the theory that the air-permeable material contributes to reduce the unwanted sound which might otherwise be generated in the ventilation device.

If the ventilation device is a feed air device, the airflow opening represents the last passage of the airflow out of the ventilation device, corresponding to the last throttling in the ventilation system. If the ventilation device is an exhaust air device, the airflow opening represents the first passage of the air into the ventilation device, corresponding to the first throttling in the ventilation system. To arrange an air-permeable material in the airflow opening has been found to be surprisingly effective in reducing and even eliminating the occurrence of noise while retaining desired ventilation properties. The air-permeable material and its position in the airflow opening contribute to reduce, but also prevent, formation of turbulence. The air-permeable material disposed in the airflow opening counteracts the occurrence of and reduces vibrations and generation of undesirable sound which might otherwise be generated in the ventilation device. Furthermore, the air-permeable material disposed in the airflow opening contributes to reduce turbulence and thus vibrations and generation of noise that might otherwise be generated in the ventilation device and further propagated in the ventilation system. The air-permeable material disposed in the airflow opening reduces turbulence and vibrations and reduces the occurrence of noise in the ventilation device at inflow and outflow of air through the ventilation device so that unwanted sound is not further propagated in the ventilation system. By disposing the air-permeable material in the airflow opening of the ventilation device, turbulence and vibrations are reduced, and the occurrence of noise in the ventilation device at inflow and outflow of air through the ventilation device is completely eliminated so that unwanted sound is not further propagated in the ventilation system, and does not occur later on in flow path of the air through the ventilation device. Those benefits and effects are achieved with the inventive ventilation device in its capacity of a feed air device or exhaust air device.

The air-permeable material is disposed such that at airflow through the airflow opening, at least a portion of the airflow passes through the air-permeable material.

The air-permeable material may be arranged to affect the velocity profile of the airflow through the airflow opening, taken over a cross section of the airflow opening, to be such that the airflow velocity is lower at the first side of the front cover than at the first edge of the outer body.

The air-permeable material may be arranged to affect the velocity profile of the airflow through the airflow opening, taken over a cross section of the airflow opening, to be such that the airflow velocity is lowest at the first side of the front cover and highest at the first edge of the outer body.

The air-permeable material may have such shape that at airflow through the airflow opening, the airflow has a velocity profile, taken over a cross section of the air-permeable material in the airflow opening, such that the airflow velocity is lowest closest to the first side of the front cover and highest in the portion of the air-permeable material which is farthest from the first side of the front cover.

The air-permeable material may be arranged such as to at least partially cover the airflow opening. Measurements have shown that effective sound attenuation is obtained even when the filter does not cover the entire airflow opening. The air-permeable material may be arranged such as to cover the airflow opening to at least ¼, preferably to ⅓, ½, or ¾, when the airflow opening is maximally open. The air-permeable material may e.g. be configured with a thickness such as to cover a certain fraction of the size of the air supply opening. The size of the air supply opening refers to its size in a direction substantially perpendicular to the intended airflow direction.

The air-permeable material may be arranged such as to substantially completely cover the airflow opening when the airflow opening is maximally open.

The ventilation device is preferably designed such that a size of the airflow opening is adjustable. This allows an airflow through the ventilation device to be adjusted. As described above, pressure drop and airflow in the ventilation system are determined by factors such as the fan's effect and the ventilation duct's dimensions. In that the size of the airflow opening is adjustable, a pressure over the ventilation device can be throttled, and the pressure distribution in the ventilation system can be set such that effective ventilation is accomplished in all spaces connected to the ventilation system.

The air-permeable material may have a thickness in non-deformed state, taken over a cross section of the airflow opening where the air-permeable material is arranged to get deformed, such that its thickness corresponds to the size of the airflow opening when said thickness is greater than the size of the airflow opening.

The thickness of the air-permeable material may be such that the air-permeable material covers the airflow opening to at least ¼, preferably to ⅓, ½, or ¾, when the airflow opening is maximally open.

The thickness of the air-permeable material may be such that the air-permeable material covers, substantially completely, the airflow opening when the airflow opening is maximally open.

The first edge of the outer body and the first side of the front cover may be arranged to deform the air-permeable material when the size of the air flow opening is smaller than the thickness of the air-permeable material.

The size of the airflow opening may be continuously or stepwise adjustable between a maximally open position and a closed position, and values in between. When the airflow opening is in a closed position, substantially no airflow can take place through the ventilation device. At maximally open position, the airflow opening has its maximum size. How large the airflow opening is at maximally open position depends on the specific performance of the ventilation device. In particular, this value is determined by the dimension of the ventilation duct to which the ventilation device is intended to be connected.

The ventilation device accomplishes a reduction of the noise generation in that the airflow in the airflow opening passes completely or partially through the air-permeable material. The air-permeable material, which, for example, may be a fiber material, preferably comprising fibers made of PET (polyester), is preferably porous. When air flows through the air-permeable and porous material, the airflow will be spread due to the porosity of the material, and a portion of the air will spread up towards the cover.

The velocity of an airflow, or an air current, through the air-permeable material is determined by the resistance which the airflow encounters when passing through the air-permeable material. That resistance is affected by the length of the path through the material which the air has to travel, as well as the degree of porosity of the material. The longer the path through the air-permeable material that the air passes, the lower its velocity. The velocity profile of an airflow, taken cross-sectionally over the material in a direction substantially perpendicular to the direction of the airflow, will thus at each point depend on the length of the distance which the airflow is to travel through the air-permeable material. The velocity profile thus exhibits lower velocities the longer the path that the airflow is to travel through the material. An air-permeable material disposed in the airflow opening thus contributes to create a, as regards the reduced sound effect level, favorable velocity profile of the airflow through the ventilation device. This reduces, but also eliminates, the occurrence of noise effectively while achieving desired ventilation properties. The air-permeable material disposed in the airflow opening reduces and prevents the formation of turbulence. The air-permeable material disposed in the airflow opening reduces and also counteracts and reduces the occurrence of vibrations in the ventilation device. The air-permeable material disposed in the airflow opening reduces and prevents generation of undesirable sound in and by the ventilation device. The air-permeable material reduces, but can also completely eliminate the occurrence of turbulence that might create noise in the ventilation device, and prevents further propagation of any unwanted sound in the ventilation system.

The air-permeable material may preferably comprise a fiber material. Such fiber material may be a material in which the fibers are made of PET. The porous air-permeable material may, for example, consist of a filter material, for example a class G3 or G4 coarse filter, but other materials with high porosity and good air throughflow capacity are possible, e.g. foam or cast structures. Preferably, a material with even higher porosity than the above coarse filter may be used. It has also been found that the finer the fiber filaments, the better the sound attenuation obtained. Furthermore, the sound attenuating properties are affected by the thickness and/or configuration of the porous, air-permeable material. The pressure drop/the velocity profile over the air-permeable material is affected by factors such as the thickness of the material, and its degree of porosity. A thin disc of air-permeable material with low porosity can therefore provide a pressure drop/velocity profile comparable to that of a thicker disc of an air-permeable material with high porosity. It has been found that particularly good sound attenuation is obtainable with an air-permeable material having relatively high porosity and a thickness such as to cover at least the majority of the airflow opening.

The air-permeable material may have a cross-sectional profile, taken over a cross section of the airflow opening, which is broadest closest to the first side of the front cover and tapers towards the first edge of the outer body.

The air-permeable material may have a substantially triangular cross-sectional profile, taken over a cross section of the airflow opening.

The air-permeable material may have a varying air permeability beyond its cross-sectional profile, taken over a cross section of the airflow opening.

The air-permeable material may be deformable, and may be arranged to get at least partially deformed relative to the size of the airflow opening. If the air-permeable material is arranged to cover, substantially completely, the airflow opening at maximal opening, it will therefore get deformed in response to substantially any change in the size of the airflow opening. If the air-permeable material is arranged such as to only partially cover the airflow opening, it will therefore get deformed only if the size of the airflow opening is smaller than the thickness of the air-permeable material. The thickness of the air-permeable material is defined here as a dimension of the air-permeable material parallel to the direction in which the size of the airflow opening can be adjusted.

The ventilation device may comprise an outer body and a front cover. The airflow opening is formed between the first edge of the outer body and a first side of the front cover. By the first side of the front cover, also referred to as the front cover's first side, is meant the side of the front cover which is arranged such as to face towards the outer body of the ventilation device.

The ventilation device may further comprise an air duct defining element arranged centrally in the outer body such that it is at least partially surrounded by the outer body. Thereby, an airflow passage is formed between an outer side of the air duct defining element and an interior wall of the outer body. The air duct defining element may be adjustably arranged in the outer body.

The air duct defining element may be a substantially cup-shaped element. An airflow passage is then formed between an outer wall of the cup-shaped element and an interior wall of the outer body. Furthermore, the cup-shaped element is preferably designed such that an effective airflow, preferably with minimal sound generation, is achieved. The cup-shaped element may have a first end with a first cross-sectional dimension, and a second end with a second cross-sectional dimension which is greater than the first cross-sectional dimension, and a section which connects the first and the second ends. The cup-shaped element is then arranged such that at least its first end is located inside the outer body, and the front cover is attached to the second end of the cup-shaped element. The cup-shaped element may be adjustably arranged in the outer body such that a size of the airflow opening is adjustable.

The cup-shaped element may have substantially the shape of a truncated cone which is arranged such that the cone faces towards the first side of the front cover. Preferably, the truncated top may have a rounded shape.

The front cover may be attached to the air duct defining element.

The front cover may be adjustably arranged relative to the outer body, whereby a size of the airflow opening is adjustable.

The first edge of the outer body may have a dome-shape, preferably a convexly rounded shape substantially without sharp edges. The size of the air supply opening can then be determined by the shortest distance between the first edge of the outer body and the first side of the front cover. The front cover thereby affects a throttling of the pressure drop over the ventilation device.

The front cover may be configured such that air in an airflow through the ventilation device, i.e. into or out of the ventilation device, flows substantially parallel to a surface of a wall or a ceiling in which the ventilation device is arranged.

The front cover may have a substantially plane second side on the side opposite the first side. This has both technical and aesthetic functions. This design has proven to contribute to direct an airflow through the ventilation device such as to be substantially parallel to a wall or ceiling surface surrounding the ventilation device when the ventilation device is mounted on a wall or a ceiling such that a peripheral edge of the first edge of the outer body substantially abuts against the wall or ceiling surface. The front cover's second side is the side facing away from the ventilation duct and out towards the space in which the ventilation device is arranged. The plane surface entails that the ventilation device can be considered to be discreet and less conspicuous in the space in which it is installed. Also, it allows the front cover to be papered or otherwise decorated.

The front cover may have a size such that the front cover covers, at least substantially, the first edge of the outer body. The front cover may further have a size such that it extends at least partially beyond the first edge of the outer body. If the front cover has such size that it completely covers the first edge of the outer body, the front cover's second side will be the only portion of the ventilation device that is visible when the ventilation device is mounted on a ventilation system as described above.

The air duct defining element may be substantially hollow and configured such that the front cover can be attached to an inner side thereof via one or more radially resilient elements, such as clips or the like. For example, four regularly arranged metal clips or elements with a certain elasticity and spring action may be attached to the front cover to tighten against the inside of the air duct defining element. Also other numbers of metal clips or other elements can be used. Other devices are also possible. The air duct defining element may comprise at least an inner edge against which the radially resilient elements, such as clips or the like, may abut to attach the front cover to the cone. The radially resilient elements may be attached to the first side of the front cover. Their other ends, alternatively their peripheral ends, may be configured to clamp against a side of the inner edge of the air duct defining element, so as to thereby releasably attach the front cover to the air duct defining element.

The air-permeable material may be arranged such that air in an airflow through, i.e. into or out of, the ventilation device is spread towards the first side of the front cover.

The air-permeable material may be attached to the first side of the front cover. The radially resilient elements may be configured to retain the air-permeable material. The radially resilient elements thus function both to mount the air-permeable material onto the first side of the front cover, and to mount the front cover onto the air duct defining element.

The air-permeable material may be at least partially fixated to the first side of the front cover via an adhesive material, or by gluing.

Advantageously, the outer body of the ventilation device has a substantially circular-cylindrical shape. The outer body may then be configured such that the ventilation device can be mounted directly in the ventilation duct, especially directly in a so-called spiral duct. Thereby, it can be mounted directly in an existing ventilation system. The ventilation device may be configured for mounting to a wall or a ceiling, especially in an interior wall or a ceiling.

Furthermore, a ventilation system is presented which comprises at least one ventilation device as described above, a ventilation duct to which the ventilation device is connected, and a fan connected to the ventilation duct and adapted to be able to create an airflow through the ventilation device and the ventilation duct. The ventilation system may comprise a plurality of ventilation devices arranged at different positions along the duct. Thereby, a ventilation system with sound attenuation is obtained.

The ventilation devices with porous air-permeable material disclosed here can also be mounted on existing ventilation systems. They can be mounted in a ventilation system intended for constant flows, or in a system intended for regulatable fans.

DETAILED DESCRIPTION OF PREFERRED EMBODIMENTS

The ventilation device disclosed here is described primarily as a feed air device. The technical teaching is, however, even applicable to exhaust air devices. Below, a ventilation system for feed air ventilation is described. Exhaust air ventilation works similarly.

Figure 1:
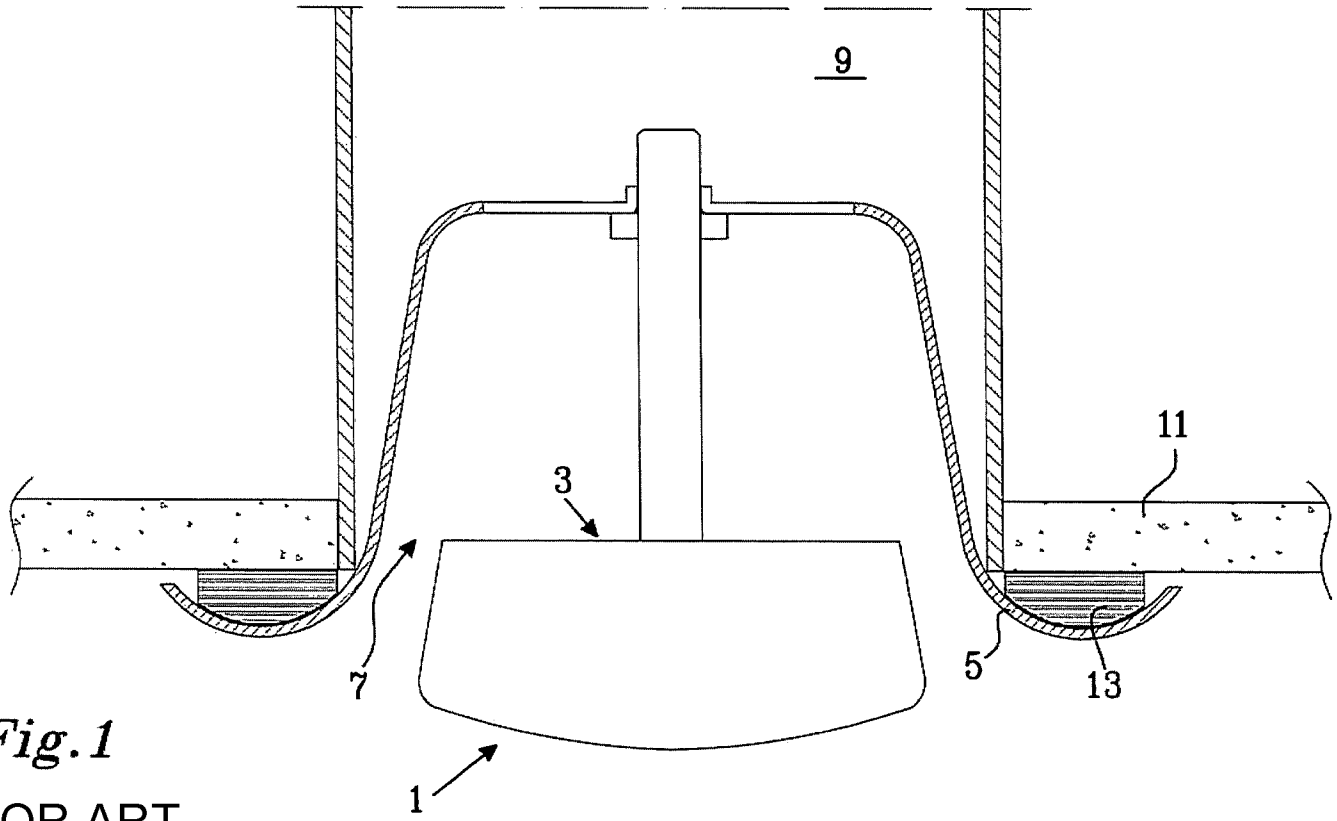
Fig. 1 PRIOR ART
FIG. 1 ventilation device according to the prior art, without attenuation.

FIG. 1 illustrates a ventilation device 1 according to the prior art. The ventilation device 1 includes a front cover 3 arranged in an outer body 5. The front cover 3 is usually adjustably arranged relative to the outer body 5, so that the size of a flow opening 7 can be adjusted. As described above, an airflow through the ventilation device 1 can be adjusted by adjusting the size of the airflow opening 7. As illustrated in FIG. 1, the ventilation device 1 may be mounted directly in a ventilation duct 9, the opening of which extends from a wall or a ceiling 11. In order to avoid air leakage along the outer sides of the outer body, the ventilation device 1 may be sealed against the wall 11 and/or the ventilation duct 9 by a sealing element 13. Examples of such a sealing element may be a foam rubber material, e.g. a foam rubber ring, or the like.

Figure 2:
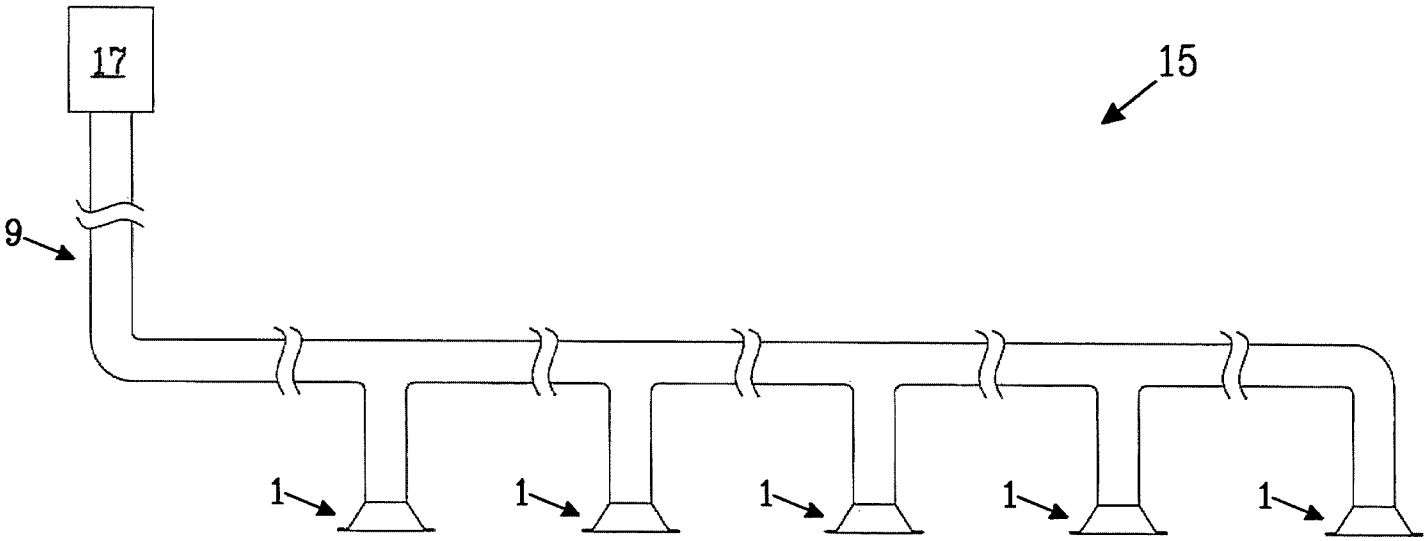
FIG. 2 ventilation system according to the present disclosure.

FIG. 2 schematically illustrates a ventilation system 15 of a type which is common in various properties, as described initially. The ventilation system 15 comprises a ventilation duct 9 to which a plurality of ventilation devices 1 are connected. As shown in FIG. 2, the ventilation device 1 may be connected at different positions along the ventilation duct 9. The ventilation duct 9 may have, as illustrated in FIG. 2, one or a plurality of branches to which one or more ventilation devices can be connected. The ventilation system 15 includes a fan 17. The fan 17 is arranged to generate a pressure in the ventilation system, so that forced ventilation can be obtained. As illustrated in FIG. 2, the ventilation system 15 can be installed in properties, e.g. in homes, and the ventilation duct 9 may extend over several different spaces for ventilation of those spaces. It may be a matter of feed air ventilation or exhaust air ventilation.

FIGS. 3A to 3E illustrate a ventilation device 21 configured to get a lower generation of sound as compared with the above described known ventilation device 1. The ventilation device 21 is configured to be connected to a ventilation duct 9, as described above for the known ventilation device 1. The ventilation device 21 can be used for various types of ventilation systems 15. For example, it can be attached to a ventilation system of the type illustrated in FIG. 2. It can be connected to existing ventilation systems. The ventilation device may be a feed air device or an exhaust air device, and can be designed for ceiling and/or wall mounting. If the ventilation device is mounted to a ventilation duct, the airflow opening 27 is the portion of the flow duct through the ventilation device 21 which is closest to the space to be ventilated. Thus, the airflow opening constitutes the ventilation device's mouth to the environment outside the ventilation duct. The airflow opening faces towards the space in which the ventilation device is arranged, and is the portion of the ventilation device which is located, flow-wise, furthest from the ventilation duct. The ventilation device can be used in various ventilation devices. The ventilation device may be designed as a feed air device or an exhaust air device. If the ventilation device is a feed air device, the airflow opening represents the airflow's last passage out of the ventilation device, i.e. the airflow opening corresponds to the last throttling in the ventilation system. If the ventilation device is an exhaust air device, the airflow opening represents the first passage of the air into the ventilation device, i.e. the airflow opening corresponds to the first throttling in the ventilation system. Generally, the airflow opening has the shape of a peripheral gap between two portions of the ventilation device.

The ventilation device 21 illustrated in FIGS. 3A-3E comprises essentially elements corresponding to those described above with reference to the known ventilation device illustrated in FIG. 1. However, the ventilation device 21 is provided with a porous air-permeable material 29 arranged in the airflow opening 27 to obtain sound attenuation. Said ventilation device will be described in more detail with reference to FIGS. 3A to 3E.

Figure 3A:
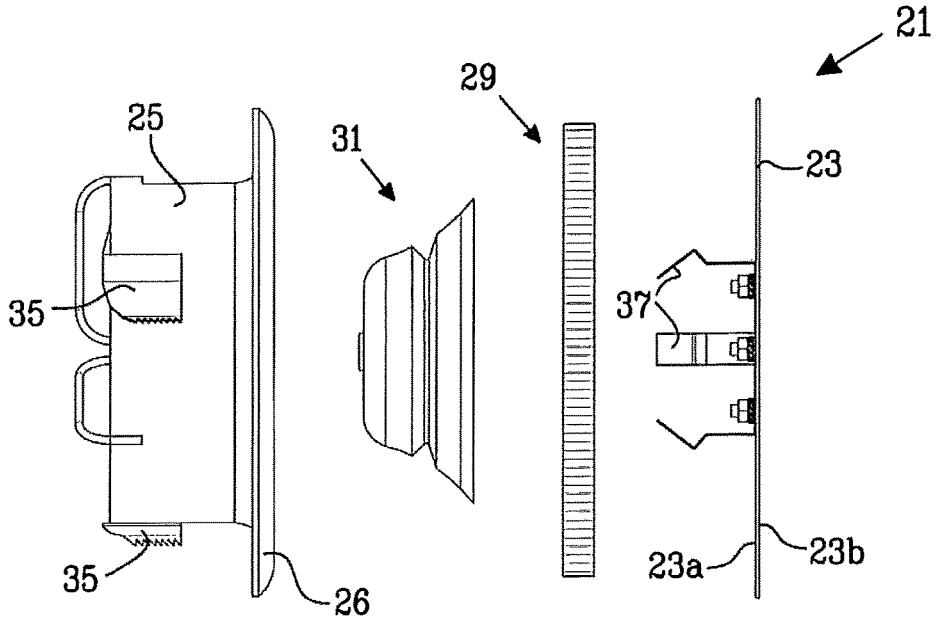
FIG. 3A ventilation device with air-permeable material for reduced occurrence/generation of sound according to an embodiment of the present disclosure, expanded view, viewed from the side.

FIG. 3A shows an exploded view of the ventilation device 21. It comprises an outer body 25, a front cover 23, and a porous, air-permeable material 29. In the embodiment illustrated here, the ventilation device 21 also includes an element 31 for mounting of the front cover 23 on the outer body 25. Said element 31 is, as illustrated here, an air duct defining element, where an airflow passage 32 is formed between an outer side of the air duct defining element 31 and at least a portion of an interior wall of the outer body 25. The configuration of the element 31 will therefore affect the airflow through the ventilation device 21, both as regards airflow resistance and acoustic properties.

If the front cover 23 is attached to the outer body 25, an airflow opening 27 will be formed between a first side 23*a* of the front cover and a first edge 26 of the outer body. The front cover 23 is adjustably arranged relative to the outer body 25, whereby a size of the airflow opening 27 is adjustable. Said size is indicated by arrow 28 in FIG. 3E, FIGS. 4A-4D, and FIGS. 5A-5C.

Figure 3B:
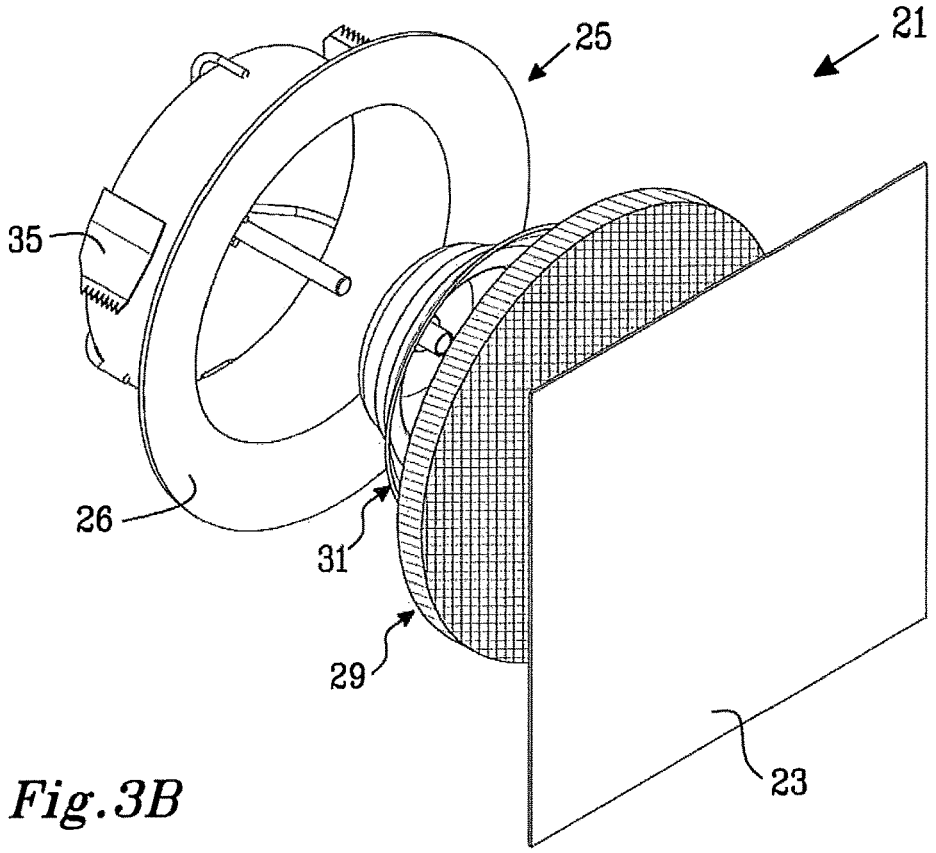
FIG. 3B ventilation device according to FIG. 3A, expanded view, viewed obliquely from the front.

FIG. 3B illustrates the ventilation device 21 in exploded view, viewed obliquely from the front. Here is also illustrated a threaded element 33, such as a screw, or other device for adjustable mounting of the air duct defining element 31 in the outer body 25. The air duct defining element 31 may be provided with an internal thread for adjustable mounting to the threaded element 33. Alternatively, the air duct defining element 31 may be positioned by means of screws or the like arranged on the threaded element 33 on both sides of the portion of the air duct defining element 31 which is intersected by the threaded element 33. As seen from e.g. FIGS. 3B and 3C, the air duct defining element 31 is arranged substantially centrally relative to the outer body 25, and is arranged to be located, at least partially, in the outer body 25. The front cover 23 is attached to the air duct defining element 31, and is thus adjustably arranged relative to the outer body 25. By adjustment of the front cover 23 relative to the first edge 26 of the outer body 25, a size 28 of the airflow opening is adjusted, which is illustrated clearly in FIG. 3E and FIGS. 5A-5C.

Figure 3C:
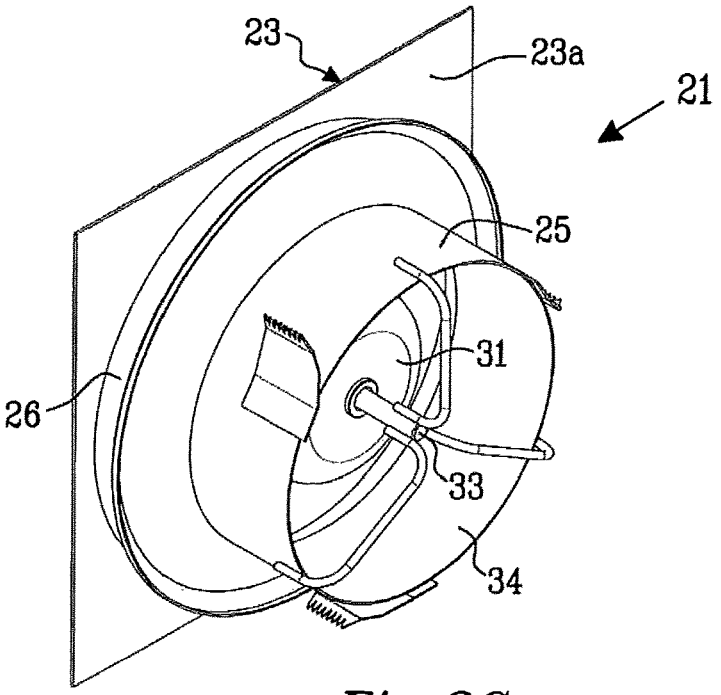
FIG. 3C, D ventilation device according to FIGS. 3A, 3B, viewed obliquely from behind and obliquely from the front.
Figure 3D:
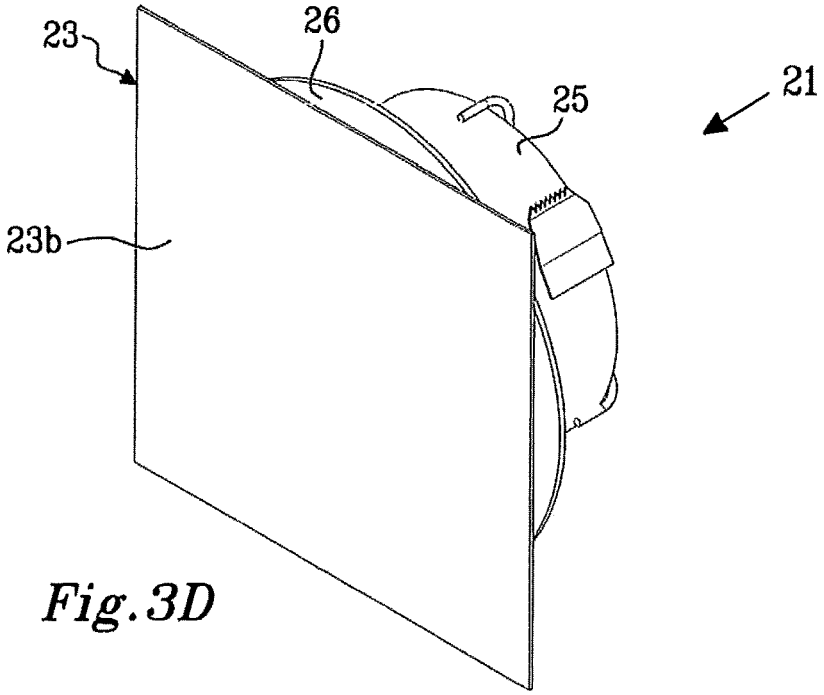
FIG. 3E ventilation device according to FIG. 3, viewed in section.

FIG. 3C illustrates the ventilation device 21, viewed obliquely from behind. FIG. 3D illustrates it, viewed obliquely from the front.

If a screw 33 or other threaded element is used for adjustable mounting of the air duct defining element 31, the position thereof may be continuously adjusted along with the screw 33. Alternatively, use may be made of another type of element which allows only stepwise adjustment of the position of the air duct defining element 31.

As illustrated here, the air duct defining element 31 is an essentially cup-shaped or cone-shaped element, and is an element separate from the front cover 23. However, according to other embodiments it might be configured to constitute a unit with the front cover. The air duct defining element 31 is arranged such that its broad portion faces towards the front cover, and its narrow portion faces towards the ventilation duct. If the air duct defining element 31 is shaped substantially like a truncated cone, it is arranged such that its base faces towards the first side 23*a* of the front cover. In the embodiment illustrated, the air duct defining element 31 is substantially hollow. However, other configurations are also possible.

Advantageously, the outer body 25 of the ventilation device has substantially circular-cylindrical shape. Advantageously, it has an outer diameter corresponding to an inner diameter of a ventilation duct to which it is to be mounted. Thus, the ventilation device can be designed for direct mounting in a ventilation duct. As there are standard dimensions of ventilation ducts, the ventilation device can be designed with corresponding standard dimensions. To facilitate direct mounting in a ventilation duct, the outer body 25 may be provided with mounting element 35, illustrated in FIGS. 3A and 3B as resilient element 35 with sufficient rigidity to make possible stable mounting in the ventilation duct. Sealing against wall or ceiling is accomplished the same way as for the known ventilation device illustrated in FIG. 1 by a sealing, e.g. a seal ring 13, positioned below the outer edge of the outer body.

Figure 3E:
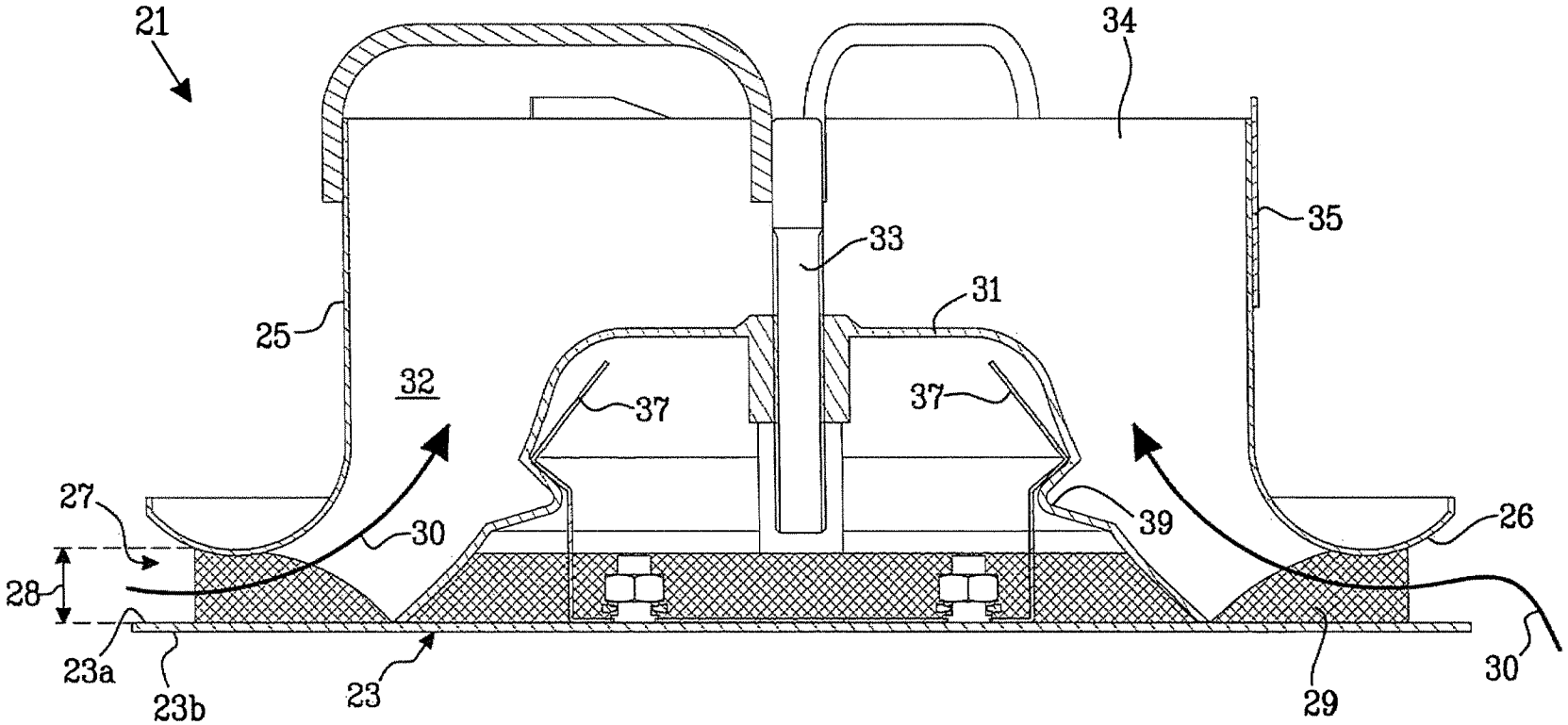

FIG. 3E illustrates the ventilation device 21 cross-sectionally. It is seen from said illustration that the air-permeable material 29 is arranged such that at airflow through the airflow opening 27, at least a portion of the airflow passes through the air-permeable material 29. This is indicated in FIG. 3E by an arrow 30. The air-permeable material 29 is arranged such as to at least partially cover the airflow opening 27. In the embodiment according to FIG. 3E, the air-permeable material covers substantially the entire airflow opening 27.

The air-permeable material 29 is arranged such as to at least constitute a portion of the airflow opening 27. The airflow opening 27 has the shape of a peripheral gap between two portions of the ventilation device 21. The air-permeable material 29 is arranged such as to at least partially cover the gap of the airflow opening 27 between the two portions of the ventilation device 21. The airflow opening 27 has the shape of a peripheral gap between the front cover 23 and the outer body 25 of the ventilation device 21. The air-permeable material 29 is arranged such as to at least partially cover the gap of the airflow opening 27 between the front cover 23 and the outer body 25 of the ventilation device 21. The airflow opening 27 has the form of a peripheral gap between the first side 23*a* of the front cover and a first edge 26 of the outer body 25 of the ventilation device 21. The air-permeable material 29 is arranged such as to at least partially cover the gap of the airflow opening 27 between the first side 23*a* of the front cover and a first edge 26 of the outer body of the ventilation device 25. The air-permeable material 29 is disposed in the gap of the airflow opening 27. The air-permeable material 29 is disposed in the gap of the airflow opening 27 between the front cover 23 and the outer body 25 of the ventilation device. The air-permeable material 29 is disposed in the gap of the airflow opening 27 between the first side/inner side 23*a* of the front cover and the first edge 26 of the outer body of the ventilation device 25. In the embodiment according to FIG. 3E, the air-permeable material covers substantially the entire gap of the airflow opening 27.

Figure 4A:
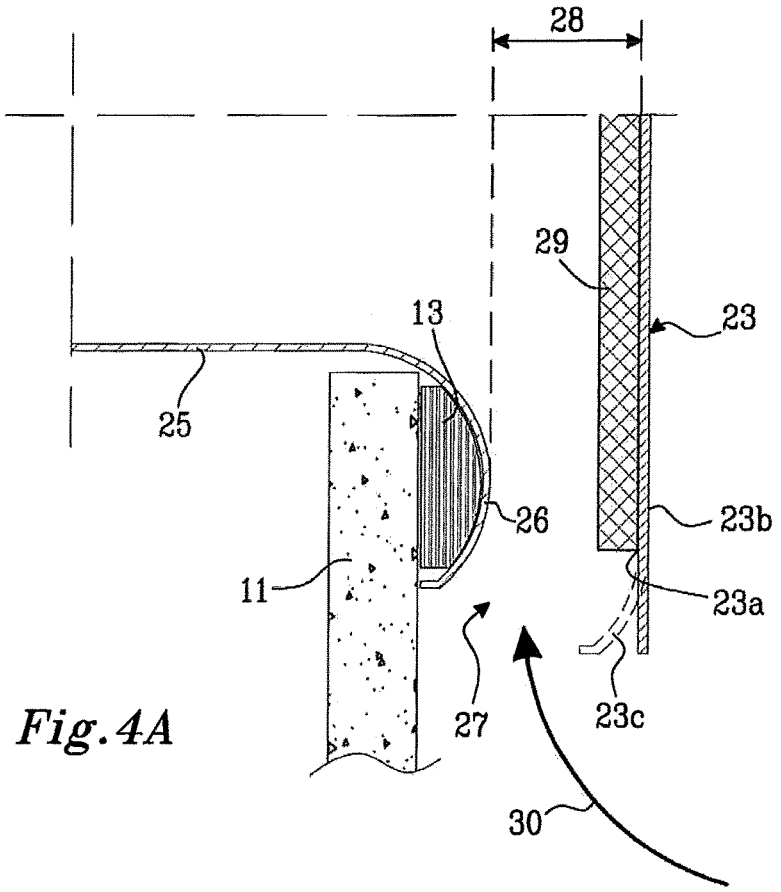
FIGS. 4A-4C detail of the airflow opening, e.g. according to FIG. 3, with air-permeable material of different thickness.
Figure 4B:
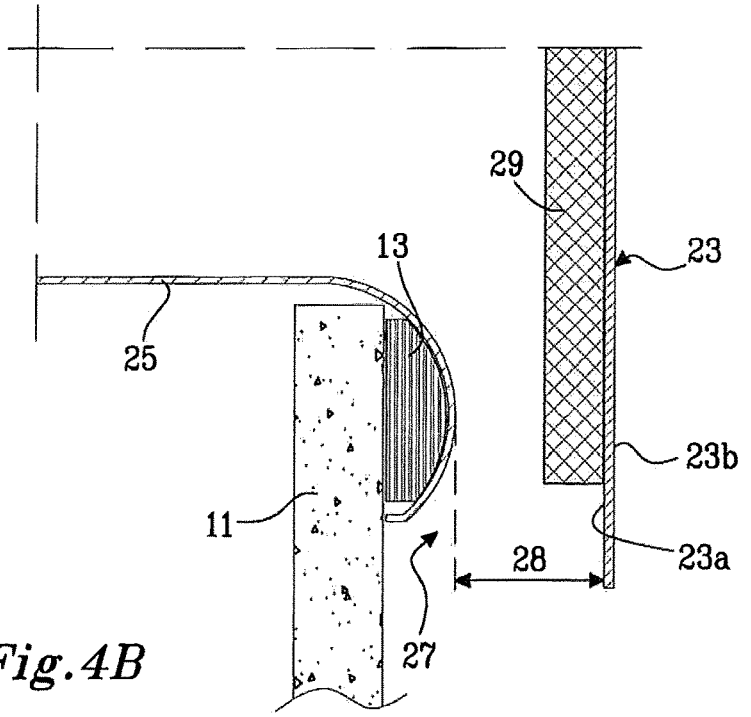
Figure 4C:
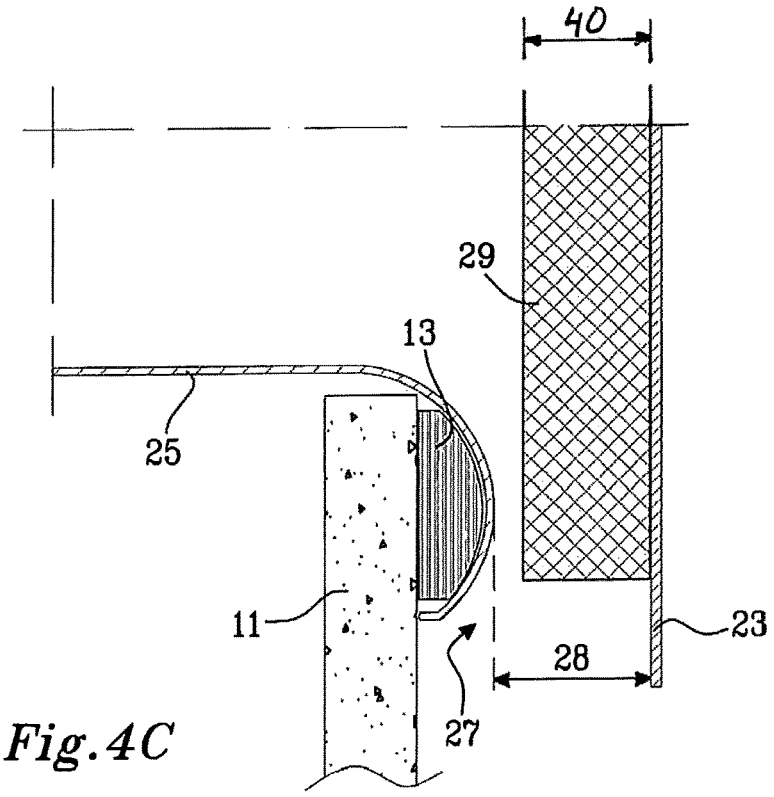
Figure 4D:
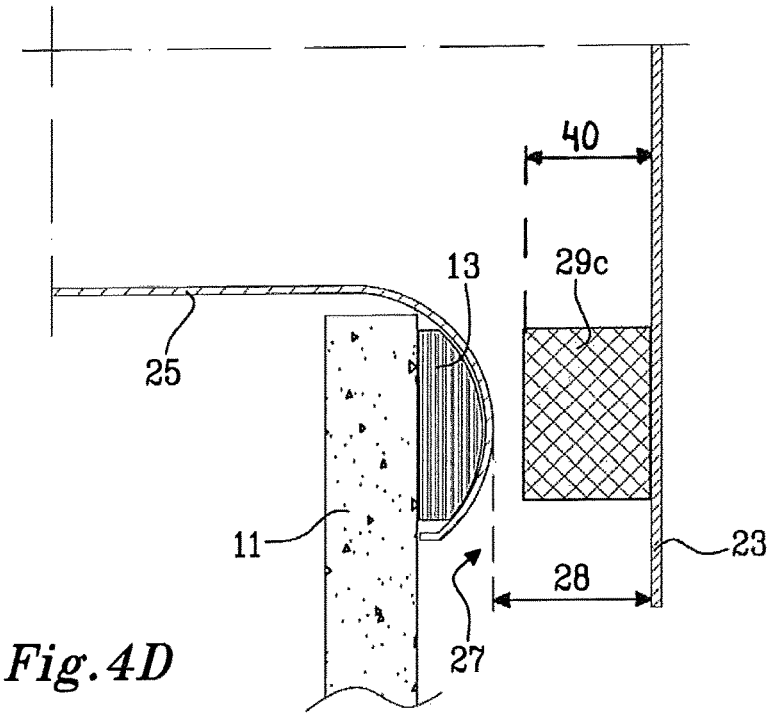
FIG. 4D detail of airflow opening according to FIG. 4C, with air-permeable material in the form of a ring.
Figure 5A:
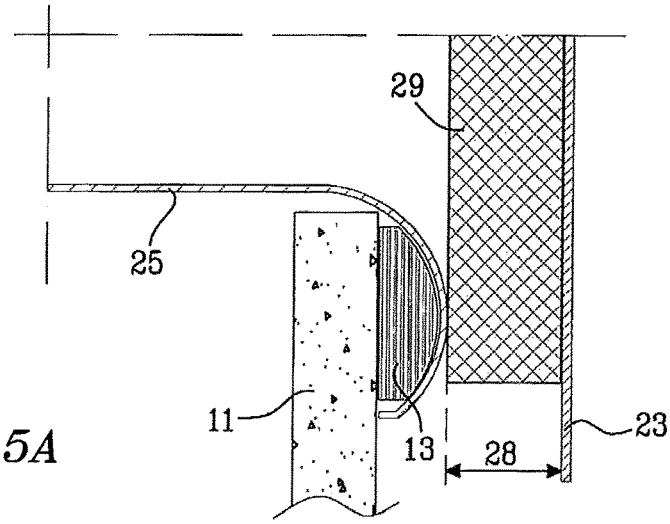
FIGS. 5A-5C detail of successive degrees of closure of ventilation device.
Figure 5B:
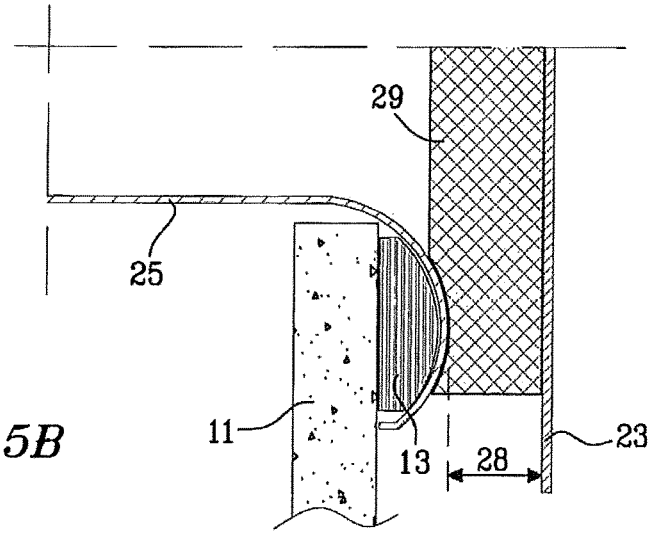
Figure 5C:
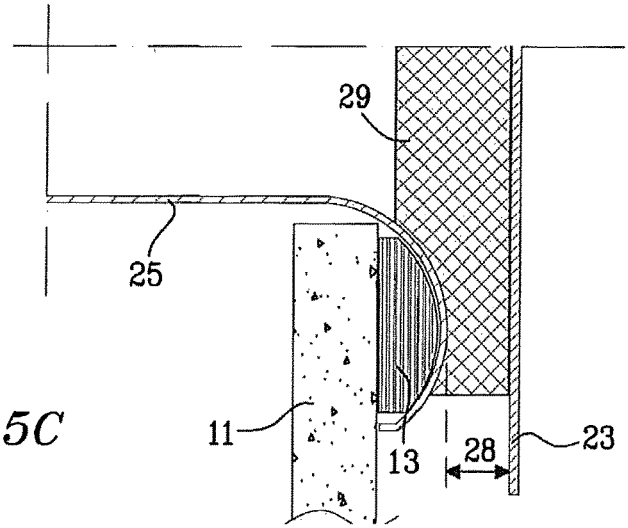

As is seen in FIGS. 3B and 3E, and in the detailed view in FIGS. 4A-4C, the first edge 26 of the outer body 25 has a dome-shape, preferably a convexly rounded shape, substantially without sharp edges. The size of the airflow opening 28 is defined as the shortest distance between the first side 23*a* of the front cover and the first edge 26 of the outer body. In the embodiment according to FIG. 3E, said size 28 is defined as the perpendicular distance between the first side 23*a* of the front cover and the closest portion of the rounded edge. This is illustrated in FIG. 3E, FIGS. 4A-4C, and FIGS. 5A-5C by arrow 28. A detailed view of the airflow opening is illustrated in FIGS. 4A-4D. Furthermore, in the embodiment according to FIGS. 4A-4D, an air-permeable material 29, 29*c* is arranged such as to partially cover the size 28 of the airflow opening at the maximally open position. As illustrated in FIGS. 4A-4C, the air-permeable material has a thickness 40, and it is possible to use air-permeable material of different thickness 40. FIGS. 4A-4C illustrate an air-permeable material 29, substantially in the form of a disc, for example according to the shape illustrated in FIG. 6A. FIG. 4D illustrates an air-permeable material 29*c*, e.g. as illustrated in FIG. 6C, substantially in the shape of a ring, the size and extent thereof substantially corresponding to the first edge 26 of the outer body. Alternatively, use may be made of an air-permeable material 29*a*, 29*b* having a shape as illustrated in FIG. 6B, where the peripheral ring 29*a* has a size and extent substantially corresponding to the first edge 26 of the outer body. The air-permeable material may be formed and arranged such as to cover the airflow opening to at least ¼, preferably to ⅓, ½, or ¾, when the airflow opening 27 is maximally open. Advantageously, it may be arranged such as to cover, substantially completely, the airflow opening 27 when the airflow opening is maximally open, as illustrated in FIG. 5A. This can be achieved in that the air-permeable material 29 may have a thickness extending over the whole or portion of the size 28 of the airflow opening. The air-permeable material need not necessarily have uniform thickness, but may have varying thickness.

In the embodiments illustrated in FIG. 3E, and FIGS. 4A-4D, and FIGS. 5A-5C, the air-permeable material 29, 29*a*, 29*b*, 29*c* is attached to the first side 23*a* of the front cover. When an airflow 30 flows through the ventilation device 21, at least a portion of said airflow will pass through the air-permeable material 29 on its way between the airflow opening 27 and the rear opening 34 of the ventilation device 21, or vice versa. If you look at the airflow velocity profile of the narrowest portion of the airflow opening, the airflow velocity is lower the further away from the first edge 26 of the outer body and the closer to the first side 23*a* of the front cover one comes. Thus, the air-permeable material contributes to give the airflow a lower velocity near the front cover 23.

As an example, we may consider the case of the exhaust air ventilation, which is illustrated by the arrow 30 in FIG. 3E and FIG. 4A. When air flows into the airflow opening 27, at least a portion of that airflow 30 will meet the air-permeable material 29, which, as illustrated in FIGS. 3E, 4A-4D, and 5A-5C, may cover, completely or partially, size 28 of the air flow opening. At its passage through the airflow opening 27, the airflow 30 will pass, at least partially, through the air-permeable material 29 before it reaches the air duct formed in the interior of the ventilation device 21. The portion of the airflow 30 which during its passage through the air-permeable material 29 has passed closest to the front cover 23, has traveled a longer distance through the air-permeable material 29 than the portion of the airflow which has flowed through the air-permeable material 29 closer to the first edge 26 of the outer body. The airflow that reaches the air duct inside the ventilation device 21 will therefore have a lower velocity in the duct the closer to the front cover it has been transported through the air-permeable material 29. Furthermore, the rounded shape of the first edge 26 of the outer body will affect the airflow velocity, as it will give rise to a gradual acceleration of the airflow 30 as it advances towards the rounded edge, and a gradual velocity reduction of the airflow 30 after the rounded edge. This reduces the degree of eddies and turbulence of the airflow 30. The air-permeable material 29, and also the rounded shape of the first edge 26 of the outer body, will therefore contribute to create a velocity profile of the airflow through the duct, which is advantageous as regards the sound effect level, in reducing the velocity of the airflow closest to surfaces inside the ventilation device.

In the case of feed air, the portion of the airflow 30 which during its passage through the air-permeable material 29 has passed closest to the front cover 23 will have traveled a longer distance through the air-permeable material 29 than the portion of the airflow which has flowed through the air-permeable material 29 closer to the first edge 26 of the outer body. The airflow which reaches the space will therefore have a lower velocity in the airflow opening the closer to the front cover it has been transported through the air-permeable material 29. The air-permeable material 29 may have different shapes to affect the airflow's velocity profile, taken over a cross section of the airflow opening, in the entire airflow opening. The airflow that reaches the space may have a velocity profile, taken over a cross section of the airflow opening, which has lower velocity closest to the first side 23*a* of the front cover 23 than at the first edge 26 of the outer body 25. The airflow that reaches the space may have a velocity profile, taken over a cross section of the airflow opening, which has the lowest velocity closest to the first side 23*a* of the front cover 23 and a highest velocity at the first edge 26 of the outer body 25. The shape of the air-permeable material 29 may be triangular. The shape of the air-permeable material 29 may be square. The shape of the air-permeable material 29 may be tapered from its base at the front cover towards the first edge 26 of the outer body 25. The porosity of the air-permeable material may vary to affect the airflow's velocity profile, taken over a cross section of the airflow opening. The porosity may vary to achieve the above velocity profiles in the airflow opening. The air-permeable material 29 may have different thickness 40 to affect the airflow's velocity profile, taken over a cross section of airflow opening 27.

The front cover 23 may further have a substantially plane second side 23*b* on the side opposite the first side 23*a*. This has turned out to have a beneficial effect on the airflow through the ventilation device, as it contributes to direct the airflow parallel to a wall or a ceiling on which the ventilation device is arranged. The front cover 23 may have one of several possible shapes. In the illustrated example, the front cover has square shape. Other possible shapes are rectangular or other polygonal shape, circular or oval. The front cover 23 may advantageously have a size such that the front cover 23 covers, at least substantially, the first edge 26 of the outer body. In the embodiment illustrated, the front cover extends at least partially beyond the first edge 26 of the outer body. In the example illustrated, the front cover 23 is substantially plane. As indicated by the dashed line in FIG. 4A, it is also possible to design the front cover 23 with a bent peripheral edge 23*c*.

In the embodiment according to FIG. 3E, the air duct defining element 31 is shaped as a hollow element having substantially the shape of a truncated cone. The truncated cone 31 is configured such that the front cover 23 can be attached to an inner side of the cone 31 via one or more radially resilient elements 37, such as clips or the like, provided on the first side 23*a* of the front cover 23. The resilient elements 37 may consist of, for example, metal bands. The element 31 comprises at least an inner edge 39 against which the radially resilient elements 37 can abut to attach the front cover to the cone. Thereby, the front cover can be easily dismounted from the element 31, which may be advantageous as regards cleaning or replacing the air-permeable material.

The air-permeable material 29 is disposed between the first side 23*a* of the front cover 23 and the air duct defining element 31. As seen in FIG. 3E, where the air-permeable material is deformable, it is fixated between a peripheral edge of the base of the air duct defining element 31, where said peripheral edge abuts substantially against the first side 23*a* of the front cover. The radially resilient elements 37 may be configured such as to also contribute to keep the air-permeable material in place. This provides a stable mechanical mounting of the air-permeable material 29, while at the same time the air-permeable material 29 can be easily replaced.

As described above, the size of the airflow opening is adjustable, whereby an airflow through the ventilation device can be adjusted. The size of the airflow opening is continuously or stepwise adjustable between a maximally open position and a closed position, and values in between. The ventilation device may be configured such that the size of the airflow opening cannot be adjusted to more than maximally open position, i.e. the maximum distance between the first side 23*a* of the front cover and the first edge 26 of the outer body has been reached, and the ventilation device cannot be opened more. At the maximally closed position, the shortest possible distance between the first side 23*a* of the front cover and the first edge 26 of the outer body 25 has been reached. Ideally, essentially no airflow is possible through the ventilation device 21 in the closed position, when the airflow opening 27 has its minimum/smallest size 28.

The air-permeable material 29 is arranged such that air in an airflow through the ventilation device 21 is spread towards the first side of the cover. This can be realized through the porosity of the air-permeable material. Furthermore, the porous air-permeable material is advantageously a fiber material, wherein the individual fibers are directed substantially randomly. This contributes to distribute and spread an airflow flowing through the air-permeable material, and to thereby affect the sound pattern that occurs at airflow through the ventilation device.

The air-permeable material 29 may be deformable, and may be arranged to get at least partially deformed relative to the size 28 of the airflow opening 27. This is illustrated in FIGS. 5A-5C, where the size 28 of the airflow opening is successively reduced. This is particularly advantageous if the porous air-permeable material has such thickness as to cover the entire airflow opening when maximally open, i.e. when the ventilation device is completely open and the airflow opening 27 has its maximum/largest size 28. The air-permeable material 29 gets deformed when its thickness 40 in non-deformed state is greater than the size 28 of the airflow opening 27. If the size 28 of the airflow opening 27 decreases, the air-permeable material 29 will abut against the first edge 26 of the outer body 25, when the thickness 40 of the air-permeable material 29 corresponds the size 28 of the airflow opening 27. If the size 28 of the airflow opening 27 is reduced further, the air-permeable material 29 gets deformed and its thickness is reduced so as to correspond to the size 28 of the airflow opening 27. When the size 28 of the airflow opening 27 is increased, the thickness of the air-permeable material 29 will increase correspondingly until it regains its thickness 40 in non-deformed state. If the size 28 of the airflow opening 27 increases further thereafter, a distance will be created between the first edge 26 of the outer body 25 and the air-permeable material 29.

If the air-permeable material 29 gets deformed, also its porosity might be changed. The air-permeable material 29 may be configured such that the porosity changes differently over its shape, when it is deformed.

Figure 6A:
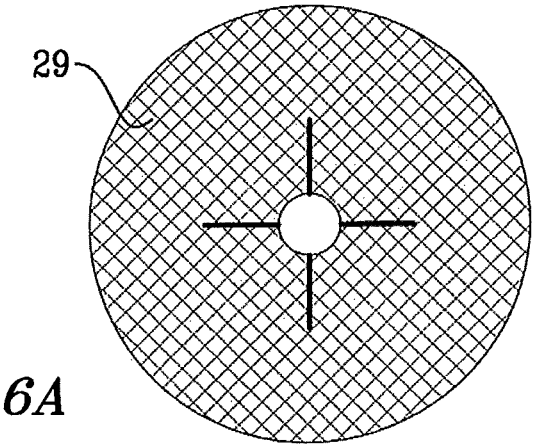
FIGS. 6A-6C alternative embodiments of the air-permeable material according to the present disclosure.
Figure 6B:
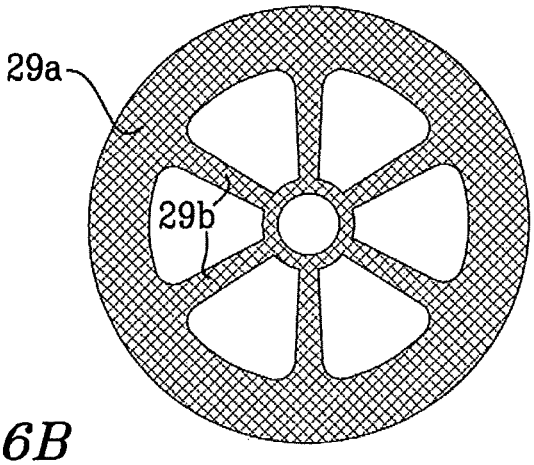
Figure 6C:
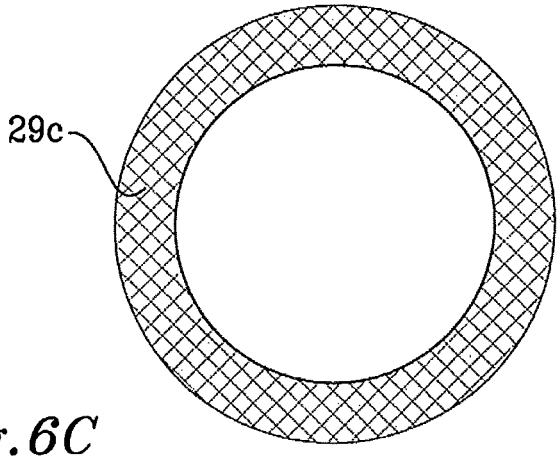

FIGS. 6A-6C illustrate some different embodiments of the air-permeable material 29. Other geometries are also conceivable. It is common to all embodiments that the thickness of at least the portion of the air-permeable material 29 disposed in the airflow opening 27 may be adapted to cover substantially the whole or a portion of the size of the airflow opening. Alternatively, or in addition to a mechanical attachment via clamping of the air-permeable material 29 to the first side 23*a* of the front cover 23, the air-permeable material can be attached to the first side 23*a* of the front cover 23, for example via adhesive material.

As shown in FIG. 6A, the air-permeable material 29 may have the shape of a circular disc. Such an embodiment makes possible a mechanical attachment of the air-permeable filter as described above with reference to FIG. 3E.

FIG. 6B shows an embodiment in which the air-permeable material 29 has a carriage-wheel-like configuration. The outer portion 29*a* will be located in the air-flow opening 27. The spokes 29*b* make possible mechanical attachment as described above.

FIG. 6C shows an embodiment in which the air-permeable material has essentially a ring shape. The extent 29*c* of air-permeable material in radial direction may have different values.

Figure 7:
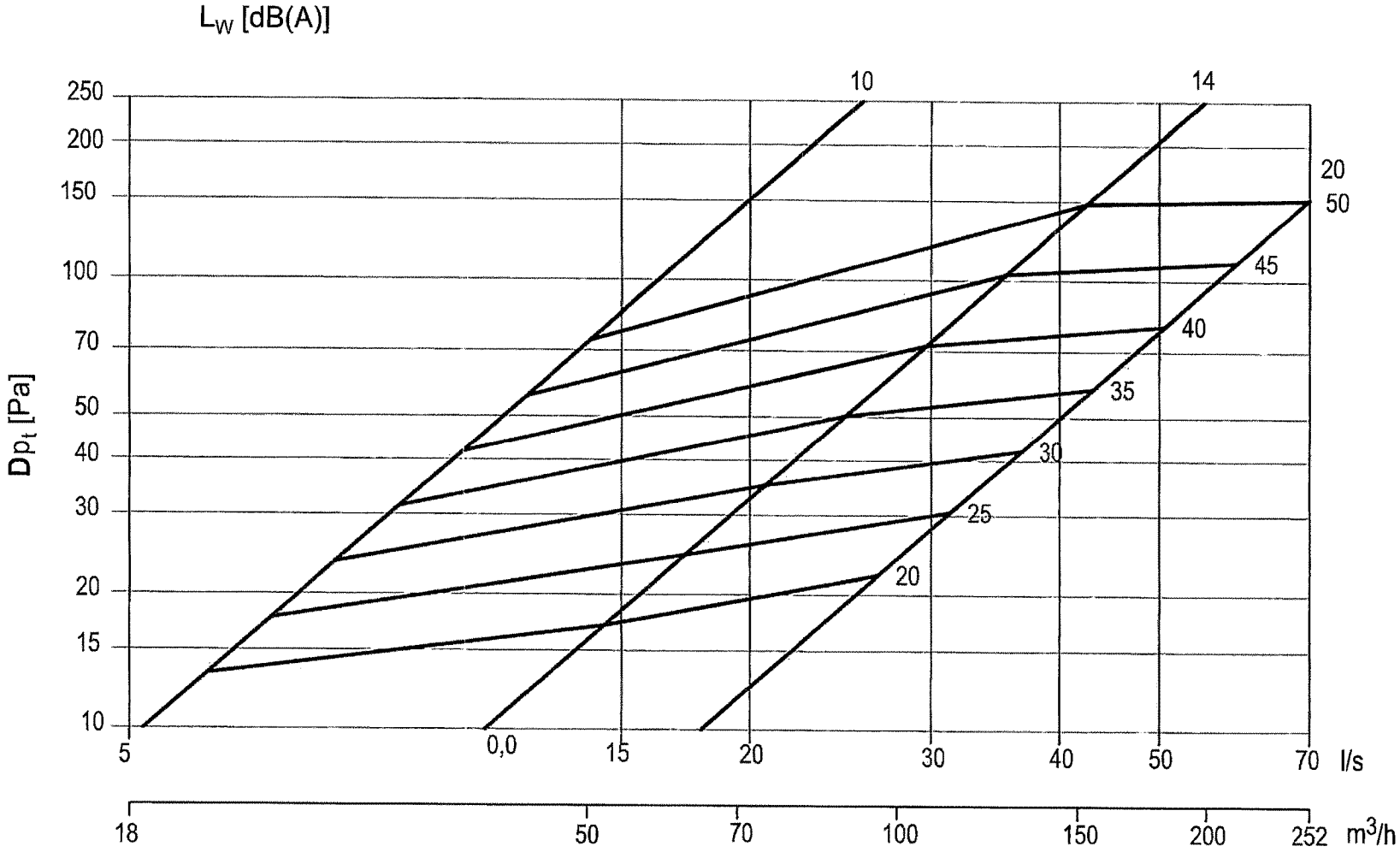
FIG. 7 diagram of measurement data for valve without sound attenuation.
Figure 8:
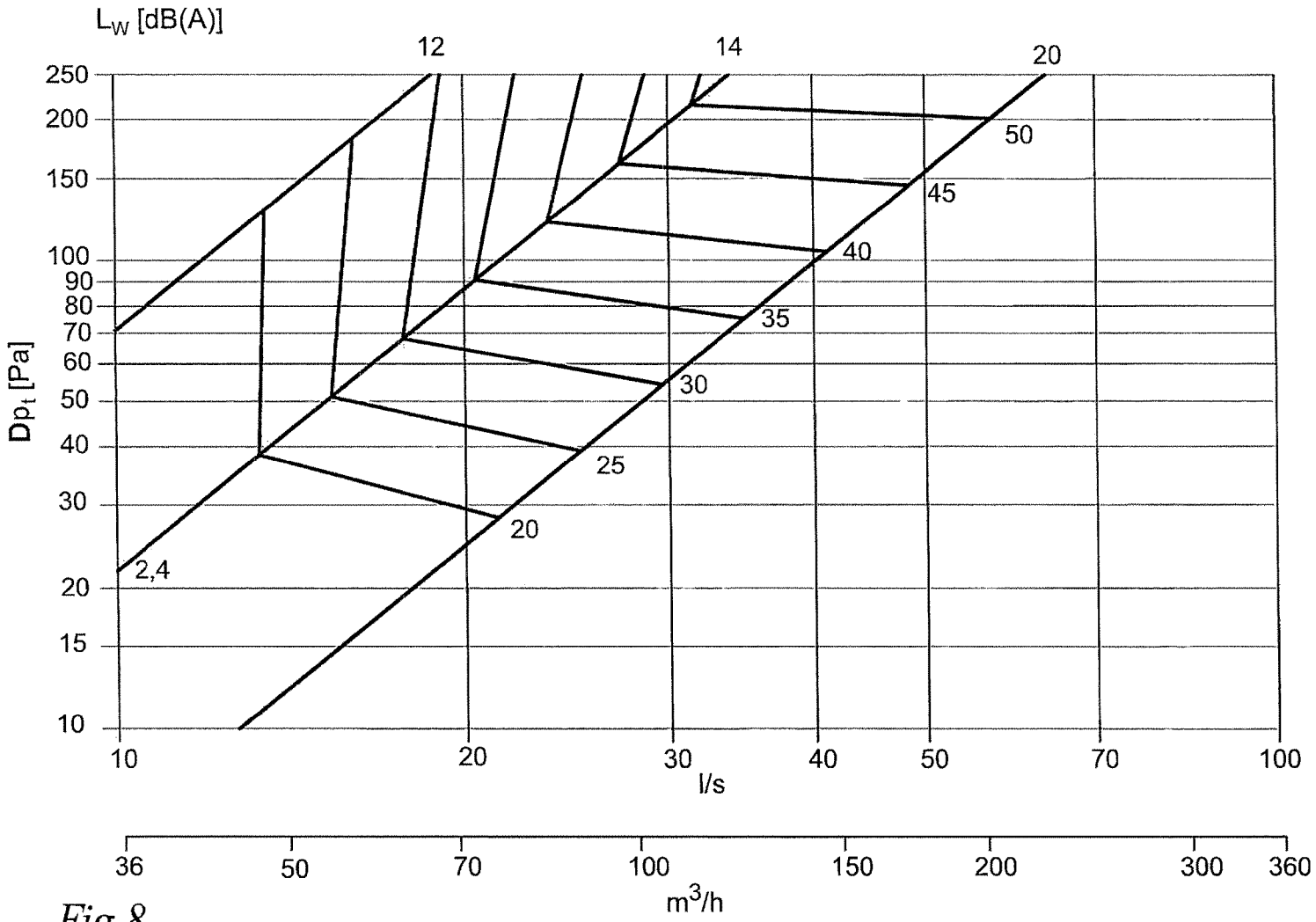
FIG. 8 diagram of measurement data for valve with porous air-permeable material with a shape according to FIG. 6A.
Figure 9:
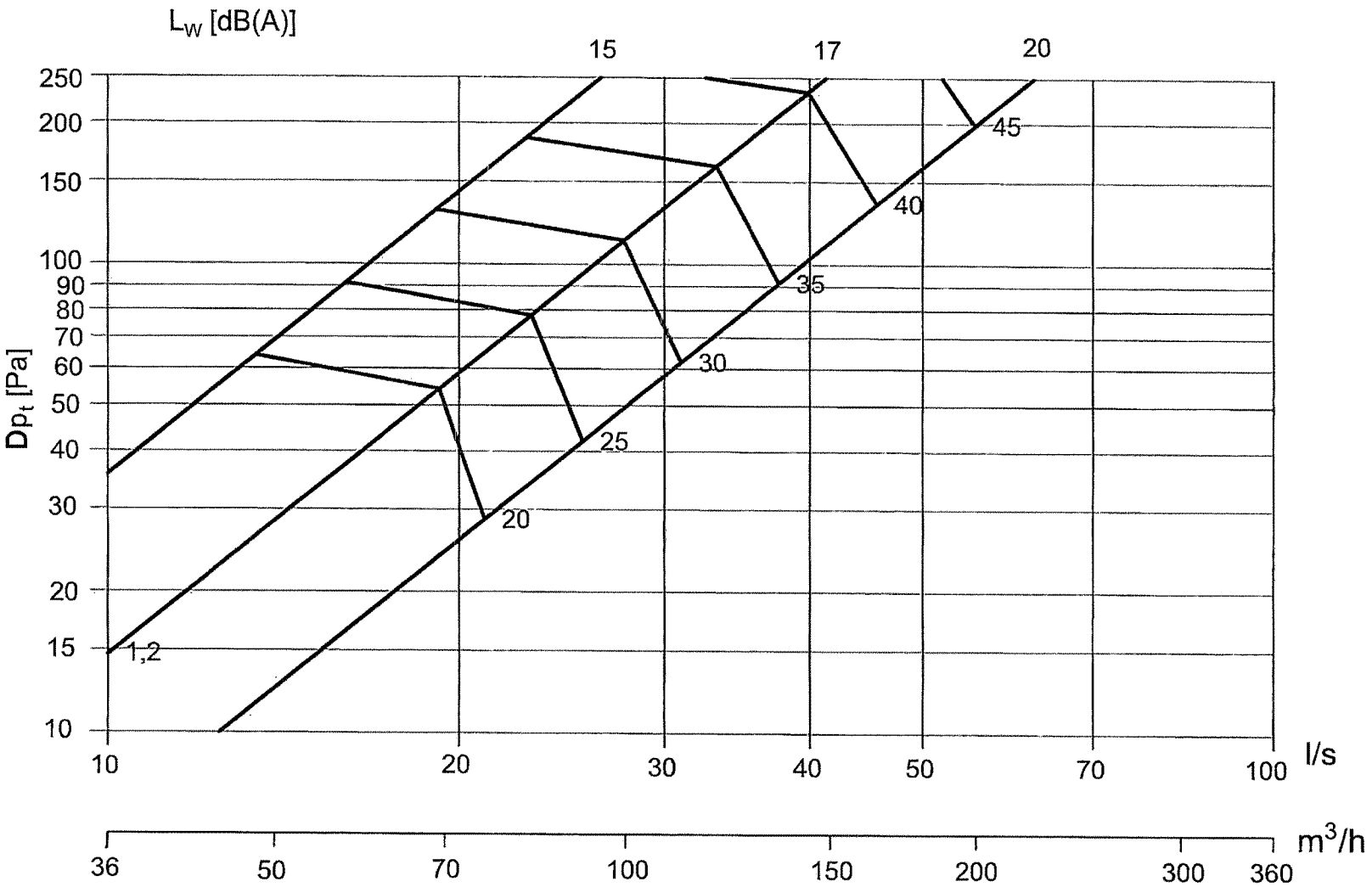
FIG. 9 diagram of measurement data for valve with air-permeable material with a shape according to FIG. 6B.

FIGS. 7-9 illustrate graphs of the relationship between airflow (l/s) (the x-axis) out of the ventilation device, here configured as an air supply device, and the maximum degree of pressure throttling $\Delta p_t$ (Pa) (the y-axis) that can be implemented without exceeding a certain sound effect level $L_w$ (dB(A)). The oblique lines extending across the diagram in the y-direction represent different opening degrees of the respective ventilation devices, i.e. different values of the size of the airflow opening, stated in mm. The lines with value designations 20, 25, 30, etc., represent measured sound effect level generated by the respective ventilation devices. The graphs in FIGS. 7-9 are all measured for ventilation ducts with the dimension 125 mm diameter. What differentiates the ventilation devices is the presence or absence of a porous air-permeable material.

For ventilation ducts with the dimension 125 mm, the standard flow is set at 20 l/s. Maximum recommended sound effect level is 30 dB(A).

In FIG. 7, the ventilation device has no air-permeable material. Here it is seen that in order to obtain an airflow of 20 l/s at 20 mm airflow opening, a pressure drop of about 13 Pa over the ventilation device is called for. 20 mm airflow opening is generally the maximum opening degree of a ventilation device as described here. However, other sizes are conceivable. As described above, the ventilation device furthest from the fan is as a standard set with maximum airflow opening. Furthermore, the diagram shows that at airflow of 20 l/s and sound limitation at 30 dB(A), a throttling of about 35 Pa can be achieved at 14 mm airflow opening. This is the maximum value to which the pressure can be throttled without exceeding the threshold value of 30 dB(A) when an airflow of 20 l/s desired. The operational range of said ventilation device is therefore limited to between 13-35 Pa.

FIG. 8 shows a corresponding diagram for a ventilation device with an air-permeable material in the form of a 5 mm thick filter material in the shape of a circular disc. From here it is apparent that the operational range lies between 25 Pa and about 68 Pa.

FIG. 9 shows a corresponding diagram for a ventilation device with an air-permeable material in the form of a 10 mm thick filter material in the shape of a wagon wheel as illustrated in FIG. 5B. From here it is seen that the operational range lies between 25 Pa and about 140 Pa.

The presence of a porous air-permeable material thus broadens the operational range of the ventilation system so that appropriate pressure distribution can be set in the ventilation system while at the same time a specified airflow distribution is achieved, and standards for sound effect levels are not exceeded.

The invention is not limited to the examples of embodiments described above and illustrated in the drawings, but may be freely varied within the scope of the appended claims.

The invention claimed is:

1. A ventilation system comprising:

a fan configured to be connected to a ventilation duct; and a ventilation device in communication with the fan via the ventilation duct to receive airflow from the fan, the ventilation device having an interior area in which an airflow passage is defined for receiving the airflow from the fan and the ventilation device being configured to be connected to a mouth of the ventilation duct between the ventilation duct and an outside space, the ventilation device comprising:

an airflow opening for passage of an airflow between the airflow passage and the outside space, and an air-permeable material arranged in said airflow opening, wherein the ventilation device comprises an outer body having an outwardly facing first edge and a front cover mounted on the outer body having an inwardly facing first side that faces the first edge and the interior area, wherein the airflow opening is formed between the first edge of the outer body and the first side of the front cover, wherein the air-permeable material is arranged in said airflow opening at least partially spanning a space between the first edge and the first side, and wherein the air-permeable material has a shape controlling airflow through the airflow opening such that at least a portion of the airflow passes through the air-permeable material and will have a velocity profile, for air exiting the airflow opening to the outside space, the velocity profile including an airflow velocity lowest in a portion of the air-permeable material closest to the first side of the front cover and highest in a portion of the air-permeable material located farthest from the first side of the front cover.

2. A ventilation system according to claim 1, wherein the air-permeable material is attached to the first side of the front cover.

3. A ventilation system according to claim 1, wherein the air-permeable material has a cross-sectional profile, taken over a cross section of the airflow opening, which is broadest closest to the first side of the front cover and tapers towards the first edge of the outer body.

4. A ventilation system according to claim 3, wherein the air-permeable material has a substantially triangular cross-sectional profile, taken over a cross section of the airflow opening.

5. A ventilation system according to claim 1, wherein the air-permeable material has a varying air-permeability across its cross-sectional profile, taken over a cross section of the airflow opening.

6. A ventilation system according to claim 1, wherein the air-permeable material comprises a porous material.

7. A ventilation system according to claim 6, wherein the porous material has a varying porosity across the cross-sectional profile of the air-permeable material, taken over a cross section of the airflow opening.

8. A ventilation system according to claim 1, wherein a size of the airflow opening is determined by the shortest distance between the first edge of the outer body and the first side of the front cover.

9. A ventilation system according to claim 1, wherein the size of the airflow opening is adjustable, whereby an airflow through the ventilation device can be adjusted.

10. A ventilation system according to claim 1, wherein the front cover is adjustably arranged relative to the outer body, whereby the size of the airflow opening is adjustable.

11. A ventilation system according to claim 1, wherein the air-permeable material covers, at least partially, the airflow opening.

12. A ventilation system according to claim 11, wherein the air-permeable material covers the airflow opening to at least ¼ of the airflow opening when the airflow opening is maximally open.

13. A ventilation system according to claim 9, wherein the air-permeable material covers, substantially completely, the airflow opening, when the airflow opening is maximally open.

14. A ventilation system according to claim 9, wherein the size of the airflow opening is continuously or stepwise adjustable between a maximally open position and a closed position, and values in between.

15. A ventilation system according to claim 1, wherein the air-permeable material is deformable.

16. A ventilation system according to claim 9, wherein the air-permeable material is arranged to get at least partially deformed relative to the size of the airflow opening.

17. A ventilation system according to claim 1, comprising an air duct defining element arranged centrally in the outer body such as to be at least partially surrounded by the outer body, wherein an airflow passage is formed between an outer side of the air duct defining element and an interior wall of the outer body.

18. A ventilation system according to claim 17, wherein the air duct defining element is a substantially cup-shaped element.

19. A ventilation system according to claim 18, wherein the cup-shaped element has the shape essentially of a truncated cone, arranged such that a base of the truncated cone faces towards the first side of the front cover.

20. A ventilation system according to claim 17, wherein the front cover is attached to the air duct defining element.

21. A ventilation system according to claim 1, wherein the first edge of the outer body has a domed, convexly rounded shape, substantially without sharp edges.

22. A ventilation system according to claim 1, wherein the front cover has a substantially plane second side on the side opposite the first side.

23. A ventilation system according to claim 1, wherein the front cover has a size such that the front cover covers, at least substantially, the first edge of the outer body.

24. A ventilation system according to claim 23, wherein the front cover extends at least partially beyond the first edge of the outer body.

25. A ventilation system according to claim 1, wherein the front cover is configured such that air in an airflow out of or into the ventilation device flows substantially parallel to an architectural surface in which the ventilation device is located.

26. A ventilation system according to claim 1, wherein the air-permeable material is at least partially fixated to the first side of the front cover via an adhesive material.

27. A ventilation system according to claim 1, wherein the air-permeable material has the shape of a disc, a ring, or a peripheral ring with radially inwardly extending element.

28. A ventilation system according to claim 1, wherein the outer body has substantially circular-cylindrical shape.

29. A ventilation system according to claim 1, configured for mounting in a wall or in a ceiling, in particular in an interior wall or a ceiling.

30. A ventilation system according to claim 1, further comprising the ventilation duct to which said at least one ventilation device is connected, wherein the fan is connected to the ventilation duct and arranged to create an airflow through the ventilation device and the ventilation duct.

31. A ventilation system according to claim 20, further including one or more radially resilient elements on the first side of the front cover that attach the front cover to the air duct defining element.

32. A ventilation device configured to be connected to a mouth of a ventilation duct between the ventilation duct and an outside space, the ventilation device comprising:

an interior area in which an airflow passage is defined for receiving airflow;

an outer body having an outwardly facing first edge;

a planar front cover mounted on the outer body and having an inwardly facing first side that faces the first edge and the interior area;

an airflow opening for passage of airflow between the ventilation device and the outside space, the airflow opening being formed between the first edge of the outer body and the first side of the front cover; and an air-permeable material arranged in said airflow opening at least partially spanning a space between the first edge and the first side, wherein the air-permeable material has a shape controlling airflow through the airflow opening such that at least a portion of the airflow passes through the air-permeable material and will have a velocity profile including an airflow velocity lowest in a portion of the air-permeable material located closest to the first side of the front cover and highest in a portion of the air-permeable material located farthest from the first side of the front cover.

* * * * *